US009220360B2

(12) United States Patent
Arai et al.

(10) Patent No.: US 9,220,360 B2
(45) Date of Patent: Dec. 29, 2015

(54) BEVERAGE CONTAINER

(75) Inventors: Keisuke Arai, Tokyo (JP); Masakazu Yoshida, Tokyo (JP); Norio Kimura, Tokyo (JP)

(73) Assignee: PIGEON CORPORATION, Tokyo (JP)

( * ) Notice: Subject to any disclaimer, the term of this patent is extended or adjusted under 35 U.S.C. 154(b) by 110 days.

(21) Appl. No.: 14/119,913

(22) PCT Filed: May 31, 2011

(86) PCT No.: PCT/JP2011/003061

§ 371 (c)(1),
(2), (4) Date: Feb. 11, 2014

(87) PCT Pub. No.: WO2012/164615

PCT Pub. Date: Dec. 6, 2012

(65) Prior Publication Data

US 2014/0166679 A1 Jun. 19, 2014

(51) Int. Cl.
*A47G 19/22* (2006.01)

(52) U.S. Cl.
CPC ..... *A47G 19/2272* (2013.01); *A47G 19/2266* (2013.01)

(58) Field of Classification Search
CPC .... B65D 51/1683; B65D 51/16; B65D 51/24; B65D 47/063; B65D 47/061; B65D 47/066; B65D 77/225; B65D 77/223; B65D 77/28; B65D 77/283; A47G 19/2205; A47G 19/2272; A47G 19/2266; A47G 19/2222; A47G 21/18
See application file for complete search history.

(56) References Cited

U.S. PATENT DOCUMENTS 5,203,468 A * 4/1993 Hsu ..... 220/254.3
6,279,773 B1 * 8/2001 Kiyota ..... 220/709

(Continued)

FOREIGN PATENT DOCUMENTS

EP 1252842 A2 10/2002
EP 2476628 A1 * 7/2012

(Continued)

OTHER PUBLICATIONS

International Search Report for PCT Patent App. No. PCT/JP2011/003061 (Aug. 16, 2011).

(Continued)

*Primary Examiner* — Anthony Stashick
*Assistant Examiner* — James Way
(74) *Attorney, Agent, or Firm* — Cermak Nakajima & McGowan LLP; Tomoko Nakajima

(57) ABSTRACT

A beverage container includes a container main body, an inner lid portion that covers the container main body, a spout portion which is formed on the inner lid portion and through which a beverage is discharged, a spout blocking portion 3*a* that blocks the spout portion, an outer lid portion disposed so as to be able to engage with and disengage from the inner lid portion, a ventilation portion that allows air to flow between the inside and the outside of the container main body, and a vent blocking portion formed on the outer lid portion or the inner lid portion to block the ventilation portion when the outer lid portion is placed to close the inner lid portion. A cancellation operation portion which cancels engagement between the outer lid portion and the inner lid portion is formed, and the beverage container further includes a ventilation adjusting protruding portion.

11 Claims, 7 Drawing Sheets

(56) References Cited

U.S. PATENT DOCUMENTS

| | | | | |
|---|---|---|---|---|
| 8,360,267 | B1 * | 1/2013 | Chiou et al. | 220/715 |
| 2005/0040175 | A1 * | 2/2005 | Stephens | 220/705 |
| 2009/0255944 | A1 * | 10/2009 | Yamashita et al. | 220/705 |
| 2011/0049169 | A1 * | 3/2011 | Rosnak et al. | 220/705 |
| 2013/0175270 | A1 * | 7/2013 | Fujita et al. | 220/203.01 |

FOREIGN PATENT DOCUMENTS

| | | | |
|---|---|---|---|
| GB | 2367056 | A | 3/2002 |
| JP | 2002-321741 | A | 11/2002 |
| JP | 2004-042982 | A | 2/2004 |
| JP | 2006-176184 | A | 7/2006 |
| JP | 2006-230731 | A | 9/2006 |
| JP | 2006-335464 | A | 12/2006 |
| JP | 2007-176555 | A | 7/2007 |
| JP | 2009-132433 | A | 6/2009 |
| JP | 2011-057250 | A | 3/2011 |
| JP | 2011-057251 | A | 3/2011 |
| WO | WO2007/148441 | A1 | 12/2007 |
| WO | WO 2011030830 | A1 * | 3/2011 |

OTHER PUBLICATIONS

Office Action from Chinese Patent App. 201180071283.3 (Nov. 27, 2014).

Supplementary European Search Report for European Patent App. No. 11866898.7 (Nov. 17, 2014).

Office Action from Japanese Patent App. No. 2011-523263 (Jul. 15, 2015).

Office Action from Taiwanese Patent Application No. 100118982 (Sep. 25, 2015).

* cited by examiner

BEVERAGE CONTAINER

This application is a national phase entry under 35 U.S.C. §371 of PCT Patent Application No. PCT/JP2011/003061, filed on May 31, 2011, which is incorporated by reference.

TECHNICAL FIELD

The present invention relates to a beverage container that can contain a beverage inside.

BACKGROUND ART

Some beverage containers such as cups that are used by an infant or the like in drinking a beverage include a lid disposed on the container and a straw disposed in the lid. Such a straw and beverage container has the advantage of allowing an infant or the like to practice drinking a beverage in the container using the straw. Thus, many parents such as mothers use such a straw and beverage container.

The straw and beverage container includes an outer lid formed thereon and disposed to block and cover the straw so that a parent or the like can carry the beverage container with a beverage contained inside and with the straw installed therein.

However, when the parent carries the straw and beverage container with hot milk or the like contained inside and with the outer lid closed, the pressure in the container increases, leading to a difference between the pressure in the container and atmospheric pressure. Thus, when the parent opens the outer lid at a destination or the like to unblock the straw, for example, the hot milk or the like in the container may disadvantageously squirt through the straw.

Thus, a vent hole or the like which is in communication with the space in the container is conventionally formed in the lid of the beverage container to prevent, for example, a possible squirt of the beverage in the container such as milk through the straw or the like.

On the other hand, the presence of such a vent disadvantageously causes the beverage in the container to leak when the parent or the like carries the straw and beverage container in a bag or the like.

Thus, proposals have been made for a vent hole with a valve structure and a configuration in which the vent hole is allowed to perform a ventilation operation when the outer lid is opened. Furthermore, a proposal has been made to block the vent hole when the straw and beverage container is carried or when an infant or the like holds the straw in the infant's mouth and drinks the beverage in the beverage container (for example, Patent Literature 1).

RELEVANT PRIOR ART

Patent Literature

Patent Literature 1: Japanese Patent Application Laid-open No. 2006-335464 (FIG. 5, FIG. 7, FIG. 8, and the like)

SUMMARY OF INVENTION

Problem to be Solved by Invention

However, even when a configuration is adopted which uses a protruding portion to block the vent hole as in the invention described in Patent Literature 1, the protruding portion may be displaced to preclude the vent from being accurately blocked. In this case, for example, the beverage in the beverage container may disadvantageously still leak. Furthermore, even when the vent hole has a valve structure, for example, the beverage may leak if a problem or the like occurs in the valve itself.

Thus, an object of the present invention is to provide a beverage container which allows the pressure in the beverage container to be effectively and continuously released for a long period of time, thus effectively preventing, for example, possible leakage of the beverage in the beverage container.

Solution to Problem

According to the present invention, the object is achieved by a beverage container having a container main body that contains a beverage, an inner lid portion that covers the container main body, a spout portion which is formed on the inner lid portion and through which the beverage is discharged, a spout blocking portion that blocks the spout portion, an outer lid portion disposed so as to be able to engage with and disengage from the inner lid portion, a ventilation portion that allows air to flow between the inside and the outside of the container main body, and a vent blocking portion formed on the outer lid portion or the inner lid portion to block the ventilation portion when the outer lid portion is placed to close the inner lid portion, wherein a cancellation operation portion which cancels engagement between the outer lid portion and the inner lid portion is formed, and the beverage container further has a ventilation adjusting protruding portion which projects from the vent blocking portion and which is configured to allow the ventilation portion to perform a ventilation operation on the basis of a cancellation operation by the cancellation operation portion.

The above-described configuration has the vent blocking portion formed in the outer lid portion or the inner lid portion to block the ventilation portion when the outer lid portion is placed to close the inner lid portion. Thus, when the outer lid portion is placed to close the inner lid portion, that is, when a user or the like is in motion with the beverage container in a bag or the like, the ventilation portion is blocked by the vent blocking portion. Consequently, possible leakage of the beverage in the beverage container can be prevented.

On the other hand, the provision of the vent blocking portion enables the leakage of the beverage to be suppressed but causes the pressure in the container main body to be insufficiently released. This may result in, for example, a squirt of the beverage through the spout portion.

Thus, in this configuration, the vent blocking portion includes a ventilation adjusting protruding portion which projects from the vent blocking portion and which is configured to allow the ventilation portion to perform a ventilation operation on the basis of a cancellation operation by the cancellation operation portion.

Thus, for example, when a user or the like operates the cancellation operation portion to cancel the engagement between the outer lid portion and the inner lid portion, the ventilation adjusting protruding portion brings the ventilation portion into a ventilation state. This prevents the pressure in the container main body from being insufficiently released.

Preferably, the ventilation portion has a slit portion formed of an elastic member, and the ventilation adjusting protruding portion is configured to be able to enlarge the slit portion by moving a position of the ventilation adjusting protruding portion in association with the operation of the cancellation operation portion.

In this configuration, the ventilation adjusting protruding portion can enlarge the slit portion by moving a position of the ventilation adjusting protruding portion in association with the operation of the cancellation operation portion.

Thus, when the operation of the cancellation operation portion cancels the engagement between the outer lid portion and the inner lid portion, the slit portion can be reliably enlarged to ensure that the pressure in the container original is released, thus preventing, for example, a possible squirt of the beverage through the spout portion. The configuration also eliminates the need for a special operation for releasing the pressure in the container main body, in turn obviating the need for a complicated operation.

Preferably, the ventilation portion has a cylindrical portion, and the slit portion and the ventilation adjusting protruding portion are arranged in the cylindrical portion.

According to this configuration, the slit portion and the ventilation adjusting protruding portion are arranged in the cylindrical portion of the ventilation portion. Thus, the ventilation adjusting protruding portion can reliably enlarge the slit portion by, for example, pressing the cylindrical portion.

Preferably, the cancellation operation portion is configured to move to cancel the engagement of the outer lid portion with the inner lid portion, the slit portion is an elongated cut and is configured such that the leakage prevention portion is moved along a moving direction of the cancellation operation portion, and a longitudinal arrangement direction of the slit portion crosses the moving direction of the cancellation operation portion.

In this configuration, the longitudinal arrangement direction of the slit portion crosses the moving direction of the cancellation operation portion. Thus, the configuration allows the slit to be easily enlarged.

Preferably, the vent blocking portion, the ventilation adjusting protruding portion, and the cancellation operation portion are integrally formed.

According to this configuration, the vent blocking portion, the ventilation adjusting protruding portion, and the cancellation operation portion are integrally formed. This ensures cooperation with the operation of the cancellation operation portion, preventing a possible drawback such as the ventilation adjusting protruding portion not allowing the ventilation portion to carry out ventilation even though the cancellation operation portion is in operation. The configuration also enables a reduction in the number of components and in manufacturing costs.

Advantageous Effects of Invention

The present invention has the advantage of providing a beverage container which allows the pressure in the beverage container to be effectively and continuously released for a long period of time, thus effectively preventing, for example, possible leakage of the beverage in the beverage container.

DESCRIPTION OF EMBODIMENTS

Preferred embodiments of the present invention will be described below in detail with reference to the attached drawings or the like.

The embodiments described below are preferred specific examples of the present invention, and thus, various technically preferable limitations are imposed on the embodiments. However, the scope of the present invention is not limited to these aspects unless any part of the description below limits the present invention.

First Embodiment

Figure 1:
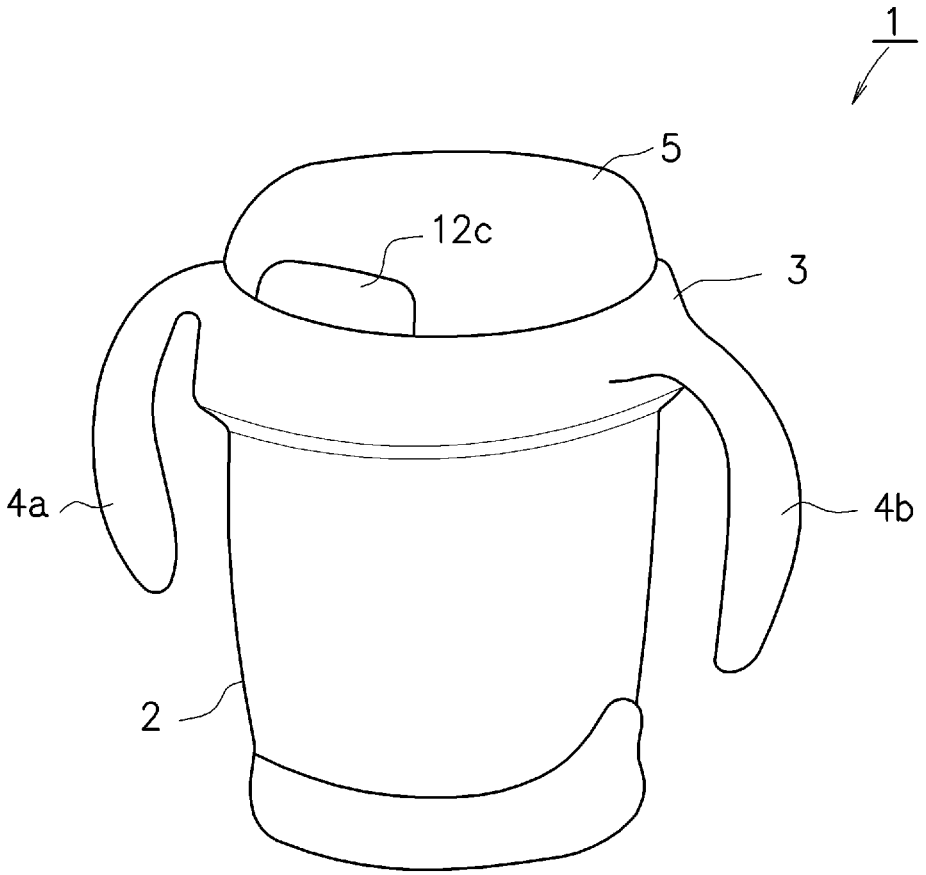
FIG. 1 is a schematic diagram showing, for example, a straw cup that is a beverage container according to the present invention.

For example, a straw cup 1 that is a beverage container shown in FIG. 1 is a cup allowing an infant or the like to, for example, practice drinking a beverage through a straw that is a pout.

As shown in FIG. 1, the straw cup 1 has a container main body 2 with an opening (not shown in the drawings) provided at one end thereof to contain a beverage for infants or the like to drink, and for example, an inner lid 3 that is an inner lid portion disposed so as to cover an opening (on the upper side of FIG. 1) in the container main body 2.

The inner lid 3 hinders a liquid contained in the container main body 2 from leaking to the exterior of the container main body 2.

Furthermore, as shown in FIG. 1, the inner lid 3 includes handles 4*a* and 4*b* disposed on the respective opposite sides thereof so as to be curved. Furthermore, an outer lid 5 that is an outer lid portion is disposed with respect to the inner lid 3.

Figure 3:
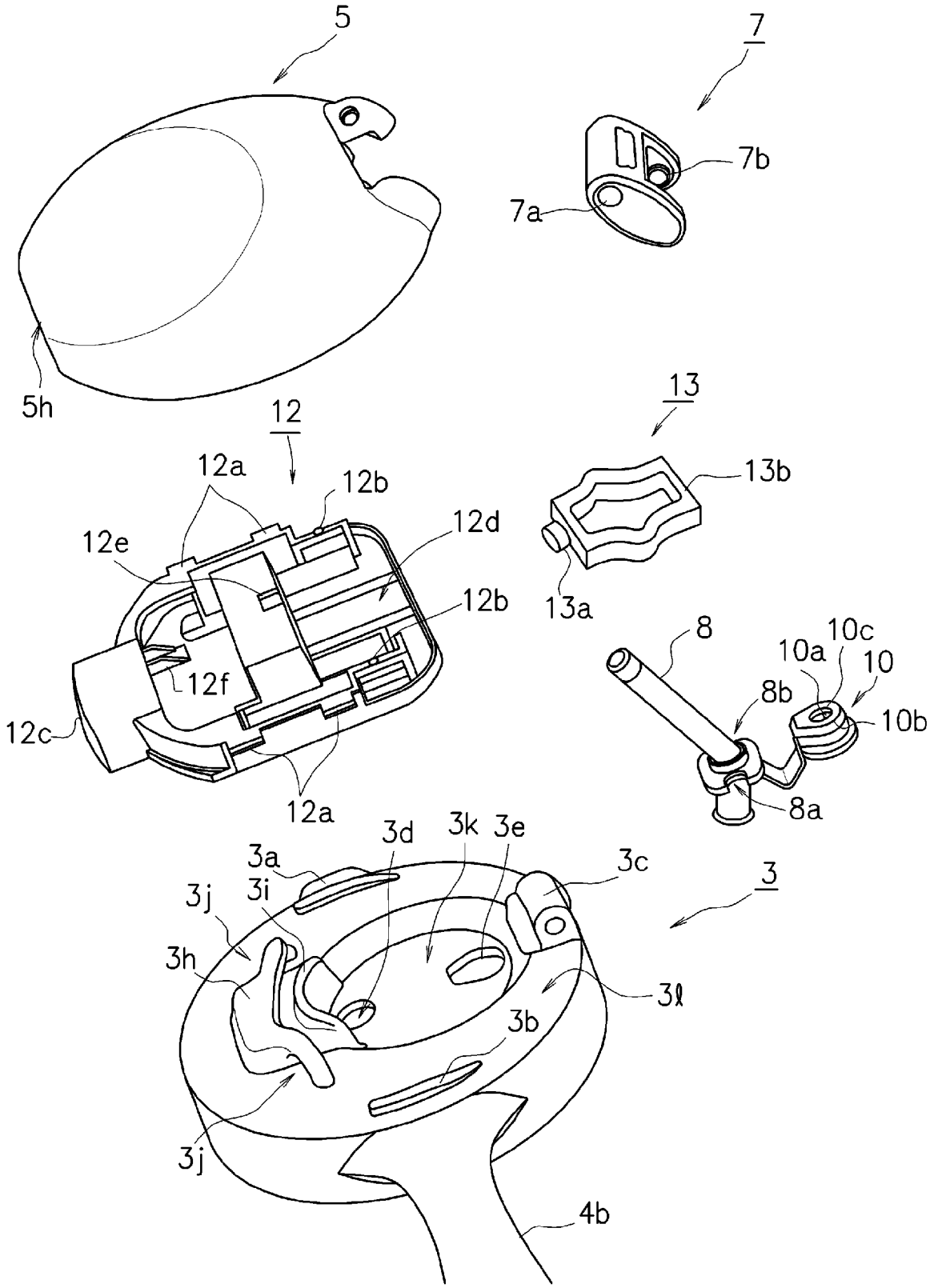
FIG. 3 is a schematic exploded perspective view of a main portion of the screw cup in FIG. 1.
Figure 4:
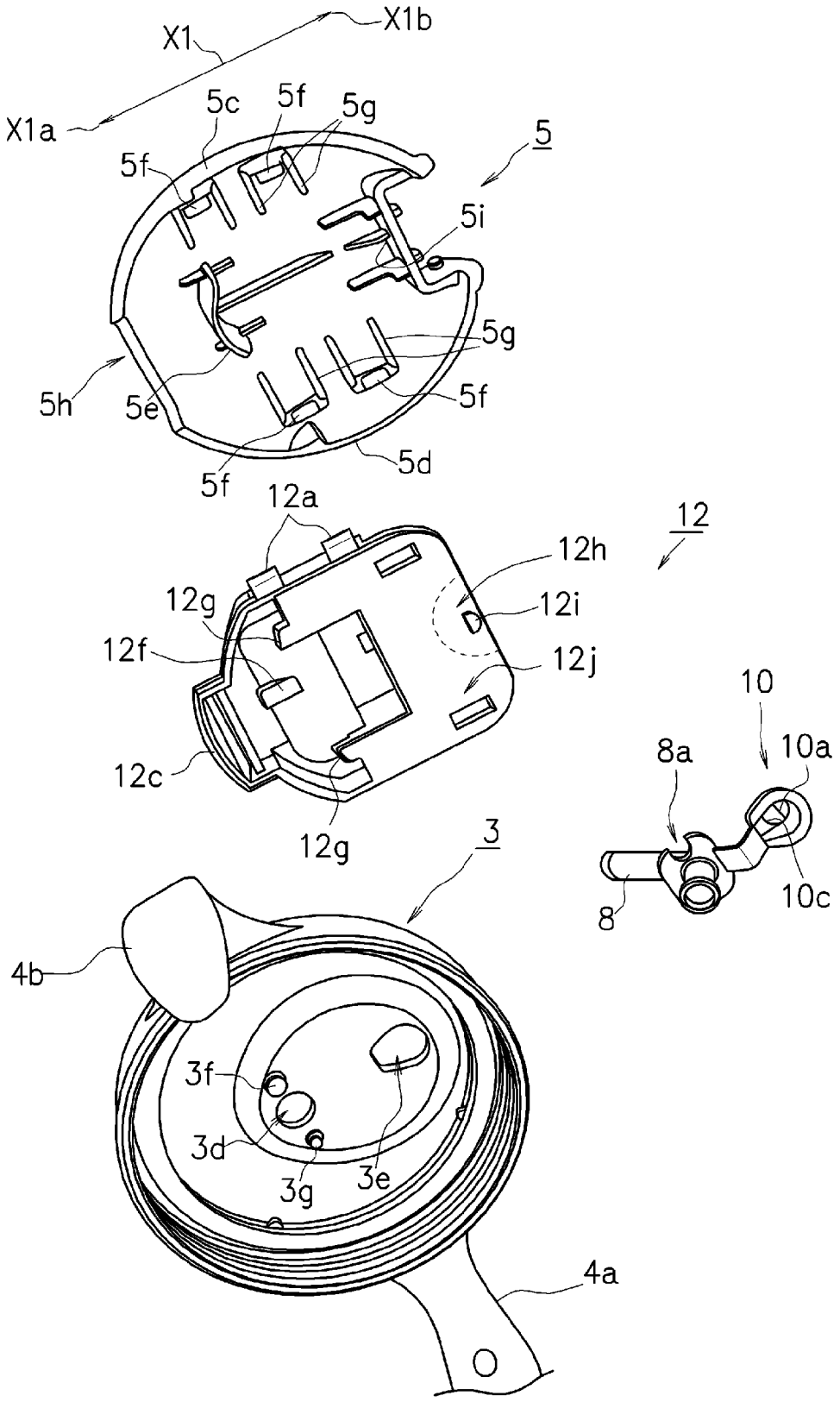
FIG. 4 is another schematic exploded perspective view of the main portion of the screw cup in FIG. 1.

As shown in FIG. 1, FIG. 3, and FIG. 4, the outer lid 5 is shaped like a dome formed to project in a direction in which the outer lid 5 is generally separate from the inner lid 3.

Furthermore, a leakage prevention plate 12 described below in detail is disposed inside the outer lid 5 so as to be movable with respect to the outer lid 5. The outer lid 5 and the inner lid 3 may be disposed to sandwich the leakage prevention plate 12 between the outer lid 5 and the inner lid 3.

The inner lid 3 has a generally circular outer shape on a planar side thereof and includes a central recess portion 3*k* formed in a central portion thereof and which is lower than an area outside the central recess portion 3*k* because the outside area forms a step with respect to the central recess portion 3*k*.

A straw insertion hole 3*d* is formed in the central recess portion 3*k* so that a straw 8 can be placed in the straw insertion hole 3*d*.

Figure 2:
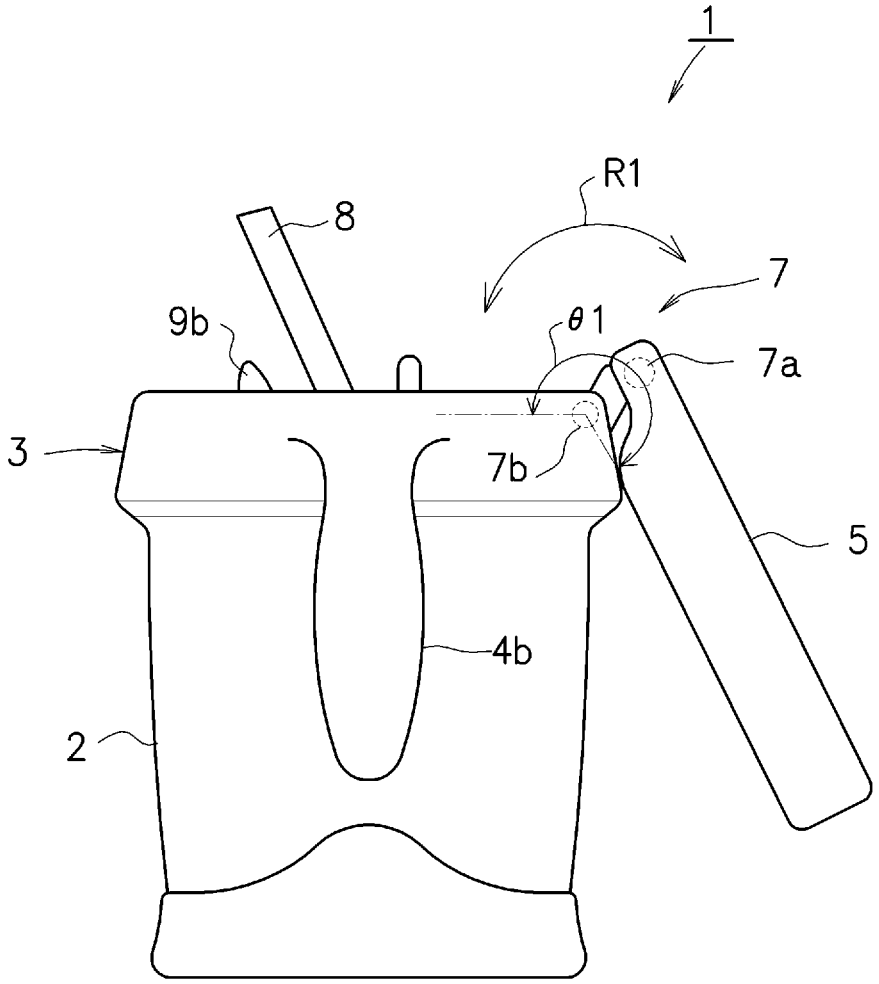
FIG. 2 is a schematic diagram showing that an outer lid of the screw cup in FIG. 1 is open.

Thus, the straw 8 can be fixedly placed with respect to the inner lid 3 as shown in FIG. 2 by placing the straw 8 in the straw insertion hole 3*d* in an inserted manner.

Furthermore, as shown in FIG. 2, the outer lid 5 is configured to be able to swing via a hinge member 7 with respect to the inner lid 3. That is, when the outer lid 5 swings along the direction of arrow R1 in FIG. 2, the outer lid 5 can be retracted from its position on the inner lid 3 or placed on the inner lid 3.

As shown in FIG. 3, the hinge member 7 has a first hinge 7*a* and a second hinge 7*b*. The use of the hinge member 7 as described above allows settings to be made such that the angle between the outer lid 5 and the inner lid 3 is about 250 degrees when the outer lid 5 is swung to maximum in a direction in which the outer lid 5 is separate from the inner lid 3 as shown in FIG. 2.

Figure 5:
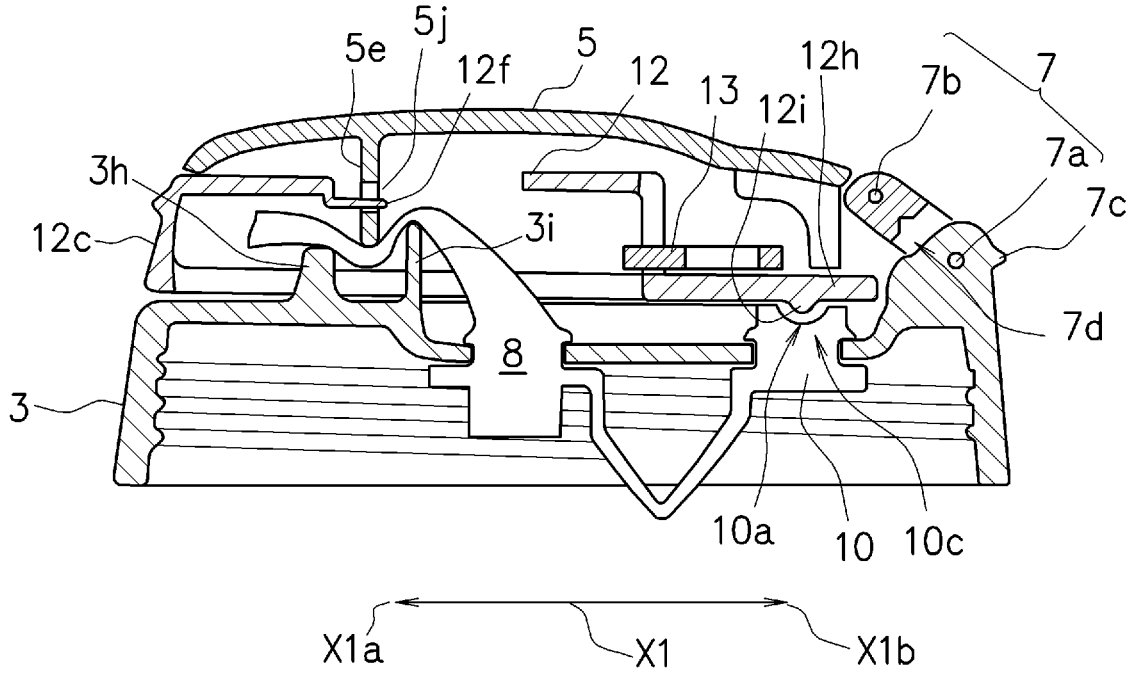
FIG. 5 is a schematic end view showing how an outer lid, an inner lid, a straw, and the like in FIG. 1 are arranged.

As shown in FIG. 5, a hinge recess portion 7*d* is formed in the hinge member 7, and a hinge protrusion 7*c* is formed on the inner lid 3 near the hinge member 7. Thus, as shown in FIG. 2, when the outer lid 5 is opened, the hinge protrusion 7*c* engages with the hinge recess portion 7*d* to allow the angle between the outer lid 5 and the inner lid 3 to be fixed to about 250 degrees as shown in FIG. 2.

As shown in FIG. 3, in the inner lid 3, two outer lid positioning projecting portions 3*a* and 3*b* are formed on a pedestal portion 3*l* formed via the step so as to be higher than the central recess portion 3*k* corresponding to an upper surface of the inner lid 3. The two outer lid positioning projecting portions 3*a* and 3*b* guide the outer lid 5 to the correct blocking position when the outer lid 5 moves to the blocking position with respect to the inner lid 3. Outer-lid outer peripheral end portion 5*c* and 5*d* (see FIG. 4) of the outer lid 5 come into abutting contact with the outer lid positioning projecting portions 3*a* and 3*b*, respectively.

Thus, as shown in FIG. 1, when the outer lid 5 is placed on the inner lid 3, the outer lid 5 can be accurately positioned. The outer-lid outer peripheral end portion 5*c* and 5*d* are formed in preparation for a case where the outer lid 5 fails to be accurately positioned by using only the hinge member 7 in FIG. 2.

Furthermore, as shown in FIG. 3, the inner lid 3 is formed with a hinge bearing portion 3*c* on which the hinge member 7 is installed.

As shown in FIG. 2, the straw 8 is formed in the inner lid 3 so as to project from the inner lid 3 in an inclined manner.

Thus, even when an infant or the like, who is a user, opens the outer lid 5 as shown in FIG. 2, grips the handles 4*a* and 4*b*, holds the straw 8 in the infant's mouth, and drinks the beverage in the container main body 2, the outer lid 5 can be opened up to the angle of 250 degrees, with the corresponding position of the outer lid 5 fixed. This prevents the outer lid 5 from coming into abutting contact with the user's face or the like. The user can thus easily drink the beverage.

As shown in FIG. 3 and FIG. 4, the central recess portion 3*k* of the inner lid 3 includes the straw insertion hole 3*d* through which the straw 8 is inserted as described above, and a vent valve installation hole 3*e* in which a vent valve 10 serving as a ventilation portion described below is installed.

As shown in FIG. 3 and FIG. 4, the straw 8 and the vent valve 10 are coupled together and formed into a single component. This enables a reduction in the number of components and manufacturing costs and in opportunities to lose components. Furthermore, the straw 8 is formed of a soft resin material or the like, which is soft enough even for a user such as an infant to hold the straw in the user's mouth.

Furthermore, as shown in FIG. 4, straw positioning bosses 3*f* and 3*g* that are protrusions allowing an insertion position for the straw 8 to be defined are formed on the respective opposite sides of the straw insertion hole 3*d* on the inside of the inner lid 3. The straw positioning bosses 3*f* and 3*g* have different sizes (shapes) as shown in FIG. 4.

On the other hand, as shown in FIG. 3, the straw 8 includes straw positioning recess portions 8*a* and 8*b* with sizes (shapes) corresponding to the straw positioning bosses 3*f* and 3*g*.

Thus, when the user or the like inserts the straw 8 into the straw insertion hole 3*d* in the inner lid 3, the straw positioning recess portions 8*a* and 8*b* are installed to fit over the straw positioning bosses 3*f* and 3*g*, thus preventing the straw 8 from being erroneously oriented.

Furthermore, when the straw 8 is installed in the inner lid 3, the straw 8 is disposed to face toward an obliquely upward and leftward side in FIG. 2, on which the user's lips or the like is placed, whereas the vent valve 10 is disposed on the right side of FIG. 2, that is, on a side further from the user's lips than the straw 8.

Thus, when the user or the like tilts the straw cup 1 and drinks the beverage through the straw 8, the vent valve 10 is located higher than the straw 8, thus allowing the beverage to be prevented from leaking through the vent valve 10.

The vent valve 10 is formed of an elastic body, and as shown in FIG. 3 and FIG. 4, a slit portion through which the pressure in the container main body 2 is released, for example, a slit 10*a*, is formed substantially in a central portion of the vent valve 10.

Thus, in the present embodiment, the slit 10*a* hinders leakage of the beverage inside the container main body 2.

As shown in FIG. 5, the slit 10*a* is formed in the vent valve 10 at a dome-shaped top portion projecting toward the container main body 2. Thus, when the user sips the beverage via the straw 8 to set the interior of the container main body 2 under negative pressure, the dome-shaped top portion moves toward the container main body 2 and is deformed to allow the slit 10*a* to be easily opened.

That is, the configuration allows air to be easily sucked into the container main body 2. Thus, the configuration prevents the user from having difficulty sipping the beverage via the straw 8 under the negative pressure inside the container main body 2.

In the present embodiment, the slit 10*a* has been described as an example of the opening. However, examples of the opening according to the present invention include not only the slit 10*a* but also a vent hole or the like.

However, as shown in FIG. 3 and FIG. 5, a first inner-lid-side blocking protrusion 3*h* and a second inner-lid-side blocking protrusion 3*i* that are spout blocking portions are arranged, in a projecting manner, on the pedestal portion 3*l* of the inner lid 3 with a predetermined spacing between the protrusions 3*h* and 3*i*.

On the other hand, an outer-lid-side blocking protrusion 5*e* that is a spout blocking portion is disposed on the outer lid 5 side in a projecting manner as shown in FIG. 4 and FIG. 5.

As shown in FIG. 4, when the outer lid 5 is allowed to close the inner lid 3, the outer-lid-side blocking protrusion 5*e* is placed between the first inner-lid-side blocking protrusion 3*h* and the second inner-lid-side blocking protrusion 3*i*.

Furthermore, at this time, the straw 8 is bent into a W shape by the outer-lid-side blocking protrusion 5*e*, the first inner-lid-side blocking protrusion 3*h*, and the second inner-lid-side blocking protrusion 3*i* to partly block an interior space in the straw 8 as shown in FIG. 4.

That is, in a longitudinal direction of the straw 8, the straw 8 can be collapsed at three positions, and the straw 8, which is configured to be blocked, can be reliably blocked. Thus, possible leakage of the beverage can be reliably prevented.

The straw cup 1 according to the present embodiment includes a leakage prevention plate 12 disposed so as to be movable with respect to the outer lid 5. This will be described below in detail.

As shown in FIG. 3 and FIG. 4, the leakage prevention plate 12 has an inner-lid-side plate 12*j* provided on an inner lid 3 side thereof and formed of a flat plate member. The flat surface of the inner-lid-side plate 12*j* allows the leakage prevention plate 12 to move smoothly with respect to the inner lid 3 when the leakage prevention plate 12 moves with respect to the outer lid 5.

Furthermore, as described above, the leakage prevention plate 12 is disposed so as to be movable to the inside of the outer lid 5 and is specifically configured as follows.

As shown in FIG. 3, the leakage prevention plate 12 has two plate side guide hooks 12*a* arranged on each side of the leakage prevention plate 12 along a moving direction of the leakage prevention plate 12 (the direction of arrow X1 in FIG. 4) with a given spacing between the hooks 12*a*. The plate side guide hooks 12*a* engage with outer-lid-side guide hooks 5*f* disposed in association with the outer lid 5 in FIG. 4 and configured so as to be movable in the direction of arrow X1 in FIG. 4. That is, the leakage prevention plate 12 is disposed so as to be slidable with respect to the outer lid 5.

Furthermore, as shown in FIG. 3, the leakage prevention plate 12 has two detent bosses 12*b*. That is, with the leakage prevention plate 12 in FIG. 11 installed on the outer lid 5 and movable in the direction of arrow X1 in FIG. 4 and the like, when, for example, the outer-lid-side guide hooks 5*f* are positioned between the two plate side guide hooks 12*a* arranged in the longitudinal direction in FIG. 3, the leakage prevention plate 12 may be disengaged from the outer lid 5.

Thus, the leakage prevention plate 12 includes the two detent bosses 12*b*, and stoppers 5*g* with which the detent bosses 12*b* come into abutting contact are formed on the outer lid 5 as shown in FIG. 4.

Thus, the leakage prevention plate 12, which engages with the outer lid 5 and which is movable in the direction of arrow X1 in FIG. 4, is motionally restricted and can be prevented from being disengaged from the outer lid 5, by the abutting contact of the two detent bosses 12*b* shown in FIG. 3 with the two stoppers 5*g* in FIG. 4.

To remove the outer lid 5 from the leakage prevention plate 12, the user or the like moves the leakage prevention plate 12 until the detent bosses 12*b* climb over the stoppers 5*g*.

Thus, the leakage prevention plate 12 can be removed from the outer lid 5 and thus easily subjected to cleaning or the like. The user or the like can easily keep the straw cup 1 sanitary.

In contrast, the removed leakage prevention plate 12 can be easily installed on the outer lid 5 by engaging the plate side guide hooks 12*a* with the outer lid guide hooks 5*f* of the outer lid 5. Thus, the leakage prevention plate 12 can be easily installed on and removed from the outer lid 5.

As shown in FIG. 4, two engagement hooks 12*g* are formed to project, along the direction of arrow X1, from the flat inner-lid-side plate 12*j* formed on the inner lid 3 side of the leakage prevention plate 12. When the leakage prevention plate 12 is installed on the outer lid 5 in FIG. 4 and the outer lid 5 closes the inner lid 3 as shown in FIG. 1, the engagement hooks 12*g* engage with engaged members 3*j* on the inner lid 3 shown in FIG. 3 to fixedly engage the outer lid 5 with the inner lid 3.

As shown in FIG. 3, the engaged members 3*j* are formed to project from the pedestal portion 3*l* of the inner lid 3 toward the leakage prevention plate 12. Hole portions into which the engagement hooks 12*g* in the leakage prevention plate 12 can be inserted are formed between the pedestal portion 3*l* and the engaged members 3*j*.

Thus, when the outer lid 5 is fixedly engaged with the inner lid 3, the straw 8 is blocked by the first inner-lid-side blocking protrusion 3*h*, the second inner-lid-side blocking protrusion 3*i*, and the outer-lid-side blocking protrusion 5*e*, as shown in FIG. 5. This reliably prevents the beverage in the container main body 2 from leaking through the straw 8.

Furthermore, as shown in FIG. 3 and FIG. 4, a cancellation operation portion, for example, a cancellation piece 12*c*, is formed on the leakage prevention plate 12 so as to project along the direction of arrow X1 in FIG. 4.

Figure 7:
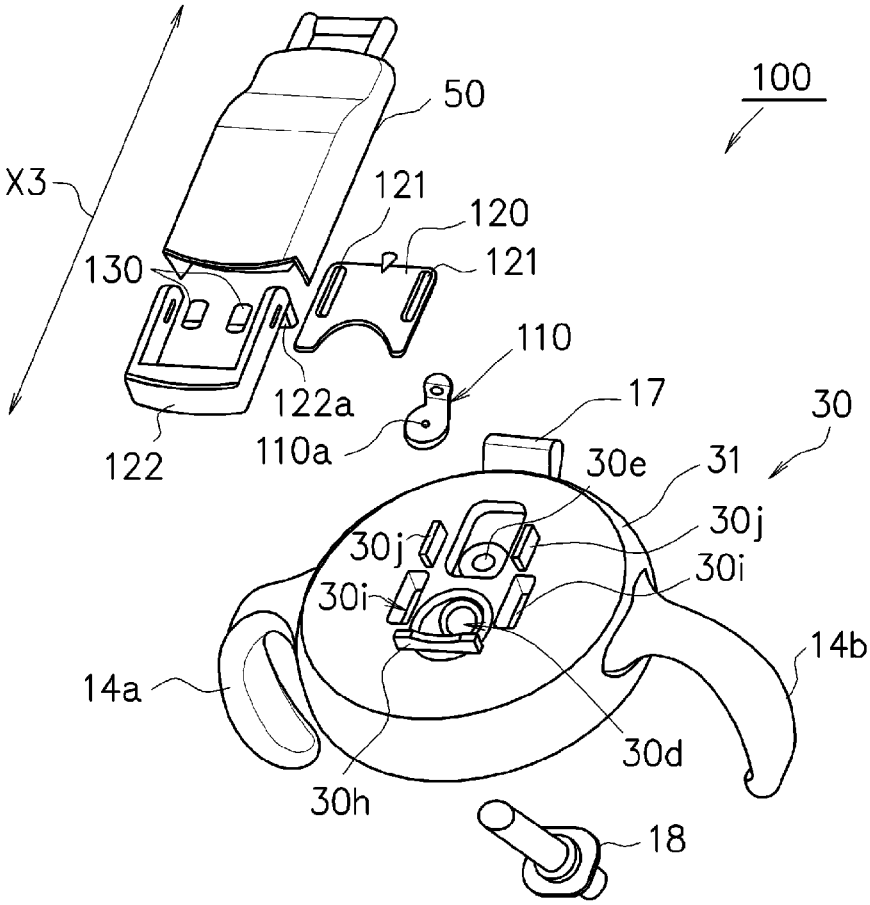
FIG. 7 is a schematic diagram showing main components of a straw cup according to a second embodiment of the beverage container of the present invention.

When the outer lid 5 with the leakage prevention plate 12 installed thereon is placed on the inner lid 3 and when the user or the like performs an operation of, for example, externally pushing the cancellation piece 12*c* in, the engagement hooks 12*g* of the leakage prevention plate 12 is disengaged from the engaged members 3*j* in FIG. 7 to cancel the engagement between the outer lid 5 and the inner lid 3.

Thus, simply by operating the engagement piece 12*c*, the user can easily cancel the engagement between the outer lid 5 and the inner lid 3.

A spring installation area 12*d* in which the spring member 13 in FIG. 3 is placed is formed on the leakage prevention plate 12 in FIG. 3. Furthermore, a spring attachment cutout 12*e* is formed in the leakage prevention plate 12 so that a spring neck portion 13*a* in FIG. 3 can be fixed in the spring attachment cutout 12*e*.

Thus, when the spring member 13 installed on the leakage prevention plate 12 is placed on the outer lid 5 in FIG. 3 along with the leakage prevention plate 12, a spring rear end portion 13*b* of the spring member 13 in FIG. 3 comes into abutting contact with a spring abutting contact portion 5*i* of the outer lid 5 in FIG. 4.

Thus, in this state, the leakage prevention plate 12 is biased in an X1a direction of arrow X1 in FIG. 4 by the spring member 13, and the cancellation piece 12*c* formed integrally with the leakage prevention plate 12 is similarly biased in the X1a direction of arrow X1 in FIG. 4.

When the leakage prevention plate 12 is engaged with and installed on the outer lid 5, the cancellation piece 12*c* is placed in a cancellation piece opening 5*h* (see FIG. 4) formed in the outer lid 5 and placed in position by being biased in a direction in which the cancellation piece 12*c* projects from the outer lid 5. Thus, the cancellation piece 12*c* is disposed such that the user or the like can easily operate the cancellation piece 12*c*, as shown in FIG. 5.

That is, by pushing the cancellation piece 12*c* against the bias force of the spring member 13, the user can move the leakage prevention plate 12 to cancel the engagement between the outer lid and the inner lid 3.

On the other hand, when the user or the like does not operate the cancellation piece 12*c*, the outer lid 5 is engaged with the inner lid 3 by the bias force of the spring member 13.

Furthermore, as shown in FIG. 4, FIG. 5, and the like, a cancellation piece holding hook 12*f* is formed on the cancellation piece 12*c* so as to project along a moving direction of the cancellation piece 12*c*.

In association with the cancellation piece holding hook 12*f*, a cancellation piece holding hook opening 5*j* is formed on the outer-lid-side blocking protrusion 5*e* of the outer lid 5 so that the cancellation piece holding hook 12*f* can be inserted and held in the cancellation piece holding hook opening 5*j*, as shown in FIG. 5.

Thus, in connection with the moving direction of the cancellation piece 12*c*, the cancellation piece holding hook 12*f* can slide through the cancellation piece holding hook opening 5*j* to prevent possible hang-down of the cancellation piece 12*c* and the like.

As shown in FIG. 4, for example, a blocking area 12*h* that is a vent blocking portion is formed on the inner-lid-side plate 12*j* of the leakage prevention plate 12. When the leakage prevention plate 12 is installed on the outer lid 5 to engage the outer lid 5 with the inner lid 3, the blocking area 12*h* covers and blocks the vent valve 10 as shown in FIG. 4.

The vent valve 10, having the slit 10*a* as shown in FIG. 4, is configured to hinder leakage of the beverage in the container main body 2. The present embodiment is further configured such that the blocking area 12*h* covers the vent valve 10 to reliably prevent possible leakage of the beverage.

In particular, if the resin surrounding the slit 10*a* is degraded due to aged deterioration, possible leakage of the beverage in the container main body 2 can be reliably prevented when the outer lid 5 is brought into the closed state because the blocking area blocks the vent valve 10.

Furthermore, as shown in FIG. 4, a pressure adjusting protrusion 12*i* that is a pressure adjusting protruding portion is formed on the leakage prevention plate 12 so as to project from a surface of the blocking area 12*h* toward the inner lid 3 side.

The pressure adjusting protrusion 12*i* is disposed over the slit 10*a* in FIG. 3 so as to lie opposite the slit 10*a* when the outer lid 5 engages with the inner lid 3.

Thus, when the outer lid 5 closes the inner lid 3, the slit 10*a* in the vent valve 10 is pressed by the blocking area 12*h* to more reliably suppress leakage of the beverage in the container main body 2.

As shown in FIG. 3, the vent valve 10 has a cylindrical portion 10*b* in which the plate-like portion 10*c* formed with the slit 10*a* is disposed.

As shown in FIG. 5, the plate-like portion 10*c* is generally shaped like a dome formed to project toward the container main body 2 side and includes the slit 10*a* formed at a top portion of the plate-like portion 10*c*.

The pressure adjusting protrusion 12*i* is disposed in the cylindrical portion 10*b* and includes a top portion disposed opposite and close to the slit 10*a*.

Thus, according to the present embodiment, the slit 10*a* is formed at the top portion of the dome-shaped plate-like portion 10*c* projecting toward the container main body 2 side, as shown in FIG. 5. Thus, when the user sips the beverage via the straw 8 to set the interior of the container main body 2 under negative pressure, the dome-shaped top portion is pulled toward the container main body 2 and elastically deformed to allow the slit 10*a* to be easily opened.

That is, air is easily sucked into the container main body 2. This configuration prevents the user from having difficulty drinking the beverage via the straw 8 under the negative pressure in the container main body 2.

Furthermore, as shown in FIG. 3 and the like, the slit 10*a* is an elongated cut, and a longitudinal direction of the slit 10*a* is arranged to cross the direction of arrow Y1, the moving direction of the leakage prevention plate 12 in FIG. 4, and in the present embodiment, for example, to cross the direction of arrow Y1 at right angles.

Thus, as shown in FIG. 5, with the outer lid 5 engaged with the inner lid 3, when the user or the like operates the cancellation piece 12*c* to move the cancellation piece 12*c* in an X1b direction of arrow X1 in FIG. 4, the pressure adjusting protrusion 12*i* moves in the same direction.

At this time, since the longitudinal cut of the slit 10*a* is disposed to cross the direction of arrow X1 at right angles, the pressure adjusting protrusion 12*i* operates to enlarge the slit 10*a*.

Figure 6:
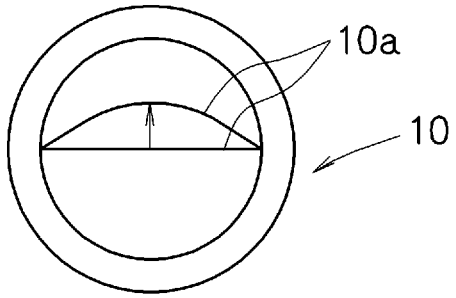
FIG. 6 is a schematic diagram illustrating that a slit is enlarged by a pressure adjusting protrusion.

That is, as shown in FIG. 6, the slit 10*a* is enlarged to a large extent by the pressure adjusting protrusion 12*i*.

Furthermore, as shown in FIG. 4, the pressure adjusting protrusion 12*i* appears to be a semi-circle in a plan view. Thus, when the slit 10*a* is enlarged using the pressure adjusting protrusion 12*i*, the semi-circular arc portion presses the inside of the cylindrical portion 10*b* in FIG. 3.

Thus, even when the cylindrical portion 10*b* is repetitively pressed by the pressure adjusting protrusion 12*i*, the cylindrical portion 10*b* is unlikely to be damaged, and ventilation can be ensured. Furthermore, the product life of the vent valve 10 can be extended.

As described above, according to the present embodiment, before the user uses the cancellation piece 12*c* to open the outer lid 5 to unblock the straw 8, the slit 10*a* is forcibly opened by the pressure adjusting protrusion 12*i* to release the pressure in the container main body 2. This enables the beverage in the container main body 2 such as milk to be prevented from squirting through the straw 8.

Furthermore, according to the present embodiment, the leakage prevention plate 12 is formed integrally with the cancellation piece 12*c*, the blocking area 12*h*, and the pressure adjusting protrusion 12*i*. This ensures the operation of the cancellation piece 12*c* and the cooperation between the blocking plate 12*h* and the pressure adjusting protrusion 12*i*. Thus, a possible drawback can be prevented in which, for example, even though the cancellation piece 12*c* is in operation, the pressure adjusting protrusion 12*i* prevents the vent valve 10 from performing a ventilation operation.

As described above, according to the present embodiment, the slit 10*a* is formed in the vent valve 10. This enables the leakage of the beverage in the container main body 2 to be hindered and allows the pressure in the container main body 2 to be easily released.

Furthermore, the blocking area 12*h* and the pressure adjusting protrusion 12*i* enable the beverage to be prevented from leaking through the slit 10*a*. Moreover, the slit 10*a* is forcibly enlarged by the pressure adjusting protrusion 12*i* in order to prevent the beverage from squirting through the straw 8 when the outer lid 5 is opened. Therefore, the user or the like can easily use the straw cup 1.

Second Embodiment

A straw cup 100 according to a second method of the present invention will be described below with reference to FIG. 7 to FIG. 10. As described below, the straw cup 100 according to the present embodiment shown in FIG. 7 includes a container main body 2 (not shown in the drawings) as is the case with the first embodiment.

Furthermore, those of the descriptions of the configuration, operation, effects, and the like of the present embodiment which are similar to corresponding descriptions of the first embodiment are simplified or omitted. Differences from the first embodiment will mainly be described.

As shown in FIG. 7, the straw cup 100 in the present embodiment has an inner lid 30 disposed to cover a container main body (not shown in the drawings).

As shown in FIG. 7, an inner lid main body 31 appearing to be generally circular in a plan view is formed on the inner lid 30. Handles 14*a* and 14*b* are disposed on the respective opposite sides of the inner lid main body 31.

Figure 8:
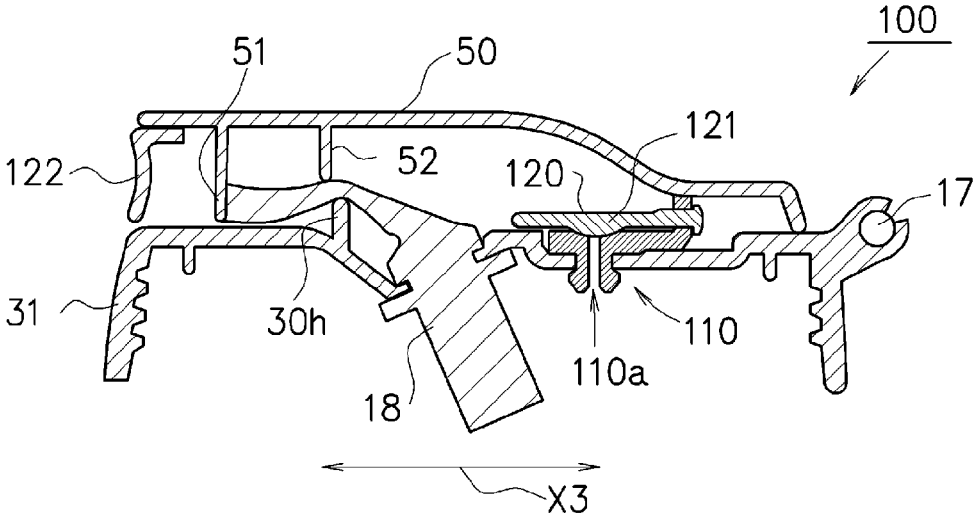
FIG. 8 is a schematic cross-sectional view of main components of the straw cup in FIG. 7.

As shown in FIG. 7, a straw insertion hole 30*d* is formed in the inner lid main body 31, and as shown in FIG. 8, a straw 18 is disposed in the straw insertion hole 30*d* so as to project upward from the inner lid main body 31.

Furthermore, a vent valve installation hole 30*e* is formed in the inner lid main body 31, and a vent valve 110 shown in FIG. 7 is installed in the vent valve installation hole 30*e*.

As shown in FIG. 7 and FIG. 8, a blocking plate 120 is disposed so as to be able to block the vent valve 110, and a pressure adjusting protrusion 121 is formed on the blocking plate 120 as shown in FIG. 8.

As shown in FIG. 8, when an outer lid 50 is engaged with the inner lid 30, the blocking plate 120 is pressed by the outer lid 50 to block the vent valve 110.

That is, unlike in the first embodiment, in the present embodiment, the blocking plate 120, which is a vent blocking portion blocking the vent valve 110, is disposed on the inner lid 30 side rather than on the outer lid 50.

Furthermore, when the blocking plate 120 blocks the vent valve 110, the pressure adjusting protrusion 121 comes into abutting contact with a vent hole 110*a* in the vent valve 110 shown in FIG. 7 and FIG. 8, thus blocking the vent hole 110*a*.

Thus, according to the present embodiment, when the user brings the outer lid 50 into the closed state, the vent valve 110 is reliably blocked, allowing the beverage in the container main body to be prevented from leaking through the vent valve 110.

Furthermore, as shown in FIG. 8, when the outer lid 50 is brought into the closed state, the straw 18 is folded and blocked by a first outer-lid-side blocking protrusion 51 and a second inner-lid-side blocking protrusion 52 of the outer lid 50 and an inner-lid-side blocking protrusion 30*h* of the inner lid 30. This precludes the beverage from squirting through the straw 18.

Additionally, as shown in FIG. 7, a cancellation piece 122 located so as to be movable in the direction of arrow X3 in FIG. 8 is disposed on the outer lid 50 side via two spring members 130. The cancellation piece 122 is biased leftward in the direction of X3 in FIG. 8 by means of the spring members 130.

The cancellation piece 122 appears to be generally U-shaped in a plan view, and two engagement hooks 122*a* are formed on the respective opposite ends of the cancellation piece 122 so as to project toward the inner lid 30 side (see FIG. 7).

The two engagement hooks 122*a* of the cancellation piece 122 are configured to engage with the respective ends of engaged recess portions 30*i* formed on the respective opposite sides of the straw insertion holes 30*d* in the inner lid main body 31.

Thus, when the cancellation piece 122 is biased leftward in the direction of arrow X3 in FIG. 8 by means of the bias force of the spring member 130, the two engagement hooks 122*a* of the outer lid 50 engage with the engaged recess portions 30*i* of the inner lid main body 31 to reliably fix the outer lid 50 to the inner lid main body 31.

On the other hand, when the user pushes the cancellation piece 122 in FIG. 8 rightward in the direction of arrow X3 in FIG. 8, the two engagement hooks 122*a* of the outer lid 50 are disengaged from the engaged recess portions 30*i*. This cancels the fixation of the outer lid 50 to the inner lid main body 31.

Figure 9:
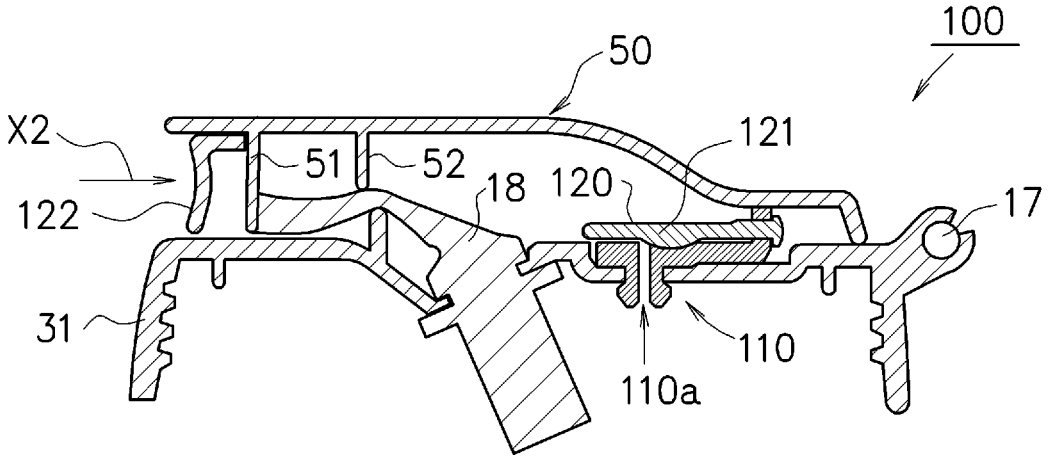
FIG. 9 is another schematic cross-sectional view of main components of the straw cup in FIG. 7.

Thus, when the user pushes the cancellation piece 122 in the direction of arrow X2 in FIG. 9, the cancellation piece 122 being biased leftward in the direction of arrow X3 in FIG. 8, the outer lid 50 and the inner lid main body 31 are disengaged from each other. Then, as shown in FIG. 10, the outer lid 50 can be opened.

Figure 10:
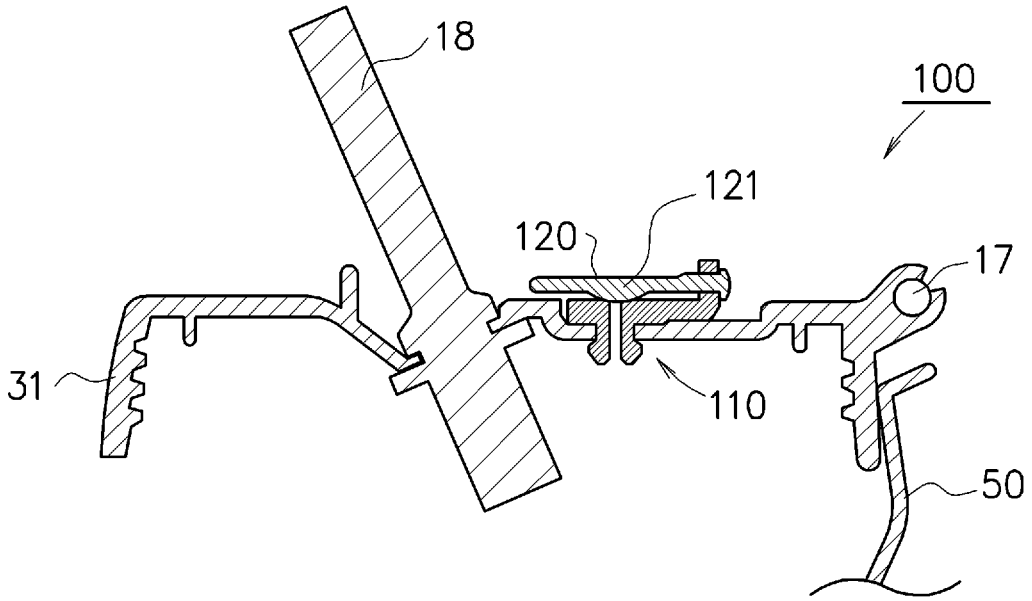
FIG. 10 is a schematic cross-sectional view showing that an outer lid of the straw cup in FIG. 7 is open.

In a state in FIG. 10, the straw 18 is available to the user, who can drink the beverage in the container main body via the straw 18.

Furthermore, as shown in FIG. 7, the cancellation piece 122 is configured to be able to come into abutting contact with the blocking plate 120. As shown in FIG. 9, when the user or the like moves the cancellation piece 122 in the direction of arrow X2, the blocking plate 120 moves in the same direction. The pressure adjusting protrusion 121 on the blocking plate 120 disposed in abutting contact with the vent hole 110*a* also moves in the same direction and is disengaged from the vent hole 110*a* of the vent valve 110.

Additionally, at this time, the pressure adjusting protrusion 121 moves so as to expand the end of the vent hole 110*a*, allowing the vent hole 110*a* to be reliably enlarged.

Furthermore, when the cancellation piece 122 is operated to open the outer lid 50, the pressing force of the outer lid 50 on the blocking plate 120 is cancelled, resulting in a gap between the blocking plate 120 and the vent valve 110 as shown in FIG. 10. Then, the pressure in the container main body can be released.

Thus, in a state in FIG. 9, when the user or the like operates the cancellation piece 122 to open the outer lid 50 of the straw cup 100 as shown in FIG. 10, a gap is formed between the blocking plate 120 and the vent valve 110. Furthermore, the pressure adjusting protrusion 121 operates to leave the position of the vent hole 110*a* and further to enlarge the vent hole 110*a*.

Thus, even if hot milk or the like is contained in the container main body, which is thus under positive pressure, the pressure is reliably released to prevent, for example, a possible squirt of the beverage through the straw 18 in the state in FIG. 10.

Thus, according to the present embodiment, an operation of opening the outer lid 50 allows the pressure in the container main body to be automatically released. Furthermore, a cancellation operation by the cancellation piece 122 allows depressurization of the interior of the container main body. Moreover, the depressurization is carried out while the straw 18 is blocked. Therefore, a possible squirt of the beverage through the straw 18 can be prevented.

Furthermore, two slide grooves 121 are formed in the blocking plate 120 along a slide direction (in the direction of arrow X3) as shown in FIG. 7.

On the other hand, two guide hooks 30*j* are provided on the inner lid main body 31 on the respective opposite sides of the vent hole 30*e* in FIG. 7 so as to extend upward from the inner lid main body 31 in the vertical direction in association with the two slide grooves 121.

Thus, when the slide grooves 121 in the blocking plate 120 are engaged with the guide hooks 30*j*, the blocking plate 120 is installed on the inner lid 30.

Furthermore, according to the present embodiment, the blocking plate 120 is also connected to the vent valve 110, and since the vent valve 110 is formed of an elastic member, returns to the original position of the blocking plate 120 against the pressure of the cancellation piece 122.

That is, even upon moving to the position in FIG. 9, the blocking plate 120 is returned to the original position thereof by the elastic force of the vent valve 110. At this time, the blocking plate 120 avoids being pressed by the outer lid 50 so as to block the vent hole 110*a*. Consequently, the blocking plate 120 covers the vent hole 110*a* but can ensure appropriate ventilation.

Thus, unlike in the first embodiment, in the present embodiment, the blocking plate 120 and the like are formed on the inner lid 30 side. However, even in this case, opening the outer lid 50 allows the pressure in the container main body to be reliably released.

EXPLANATION OF REFERENCE NUMERALS

1, 100 Straw cup
2 Container main body
3, 30 Inner lid
3*a*, 3*b* Outer lid positioning projecting portion
3*c* Hinge bearing portion

3*d*, 30*d* Straw insertion hole
3*e*, 30*e* Vent valve installation hole
3*f*, 3*g* Straw positioning boss
3*h*, 30*h* First inner lid blocking protrusion
3*i* Second inner lid blocking protrusion
3*j* Engaged member
3*k* Central recess portion
3*l* Pedestal portion
4*a*, 4*b*, 14*a*, 14*b* Handle
5, 50 Outer lid
5*c*, 5*d* Outer-lid outer peripheral end portion
5*e* Outer-lid blocking protrusion
5*f* Outer-lid-side guide hook
5*g* Stopper
5*h* Cancellation piece opening
5*i* Spring abutting contact portion
5*j* Cancellation piece holding hook opening
7, 17 Hinge member
7*a* First hinge
7*b* Second hinge
7*c* Hinge protrusion
7*d* Hinge recess portion
8, 18 Straw
10, 110 Vent valve
10*a* Slit
10*b* Cylindrical portion
10*c* Plate-like portion
12 Leakage prevention plate
12*a* Plate side guide hook
12*b* Detent boss
12*c*, 122 Cancellation piece
12*d* Spring installation area
12*e* Spring attachment cutout
12*f* Cancellation piece holding hook
12*g* Engagement hook
12*h* Blocking area
12*i* Pressure adjusting protrusion
12*j* Inner-lid-side plate
13, 130 Spring member
13*a* Spring neck portion
31 Inner lid main body
30*i* Engaged recess portion
30*j* Guide hook
120 Blocking plate
121 Slide groove
122*a* Engagement hook

The invention claimed is:

1. A beverage container comprising:
a container main body that contains a beverage;
a spout portion which is formed on an inner lid portion and through which the beverage is discharged;
the inner lid portion that covers the container main body, the inner lid portion includes a spout blocking portion that blocks the spout portion;
an outer lid portion disposed so as to be able to engage with and disengage from the inner lid portion;
a ventilation portion that allows air to flow between the inside and the outside of the container main body; and
a leakage prevention plate which slides with respect to the outer lid, the leakage prevention plate includes
a vent blocking portion placed between the outer lid portion and the inner lid portion to block the ventilation portion when the outer lid portion is placed to close the inner lid portion;
a cancellation operation portion which cancels engagement between the outer lid portion and the inner lid portion is formed; and
a ventilation adjusting protruding portion which projects from the vent blocking portion and which is configured to allow the ventilation portion to perform a ventilation operation on the basis of a cancellation operation by the cancellation operation portion, wherein the ventilation adjusting protruding portion is arranged to be in the ventilation portion when the outer lid portion is placed to close the inner lid portion.

2. The beverage container according to claim 1, wherein the ventilation portion has a slit portion formed of an elastic member, and the ventilation adjusting protruding portion is configured to be able to enlarge the slit portion by moving a position of the ventilation adjusting protruding portion in association with the operation of the cancellation operation portion.

3. The beverage container according to claim 2, wherein the ventilation portion has a cylindrical portion, and the slit portion and the ventilation adjusting protruding portion are arranged in the cylindrical portion.

4. The beverage container according to claim 2, wherein the cancellation operation portion is configured to move to cancel the engagement of the outer lid portion with the inner lid portion,
the slit portion is an elongated cut,
the slit is configured such that the leakage prevention portion is moved along a moving direction of the cancellation operation portion, and
a longitudinal arrangement direction of the slit portion crosses the moving direction of the cancellation operation portion.

5. The beverage container according to claim 1, wherein the vent blocking portion, the ventilation adjusting protruding portion, and the cancellation operation portion are integrally formed.

6. The beverage container according to claim 3, wherein the cancellation operation portion is configured to move to cancel the engagement of the outer lid portion with the inner lid portion,
the slit portion is an elongated cut,
the slit is configured such that the leakage prevention portion is moved along a moving direction of the cancellation operation portion, and
a longitudinal arrangement direction of the slit portion crosses the moving direction of the cancellation operation portion.

7. The beverage container according to claim 2, wherein the vent blocking portion, the ventilation adjusting protruding portion, and the cancellation operation portion are integrally formed.

8. The beverage container according to claim 3, wherein the vent blocking portion, the ventilation adjusting protruding portion, and the cancellation operation portion are integrally formed.

9. The beverage container according to claim 4, wherein the vent blocking portion, the ventilation adjusting protruding portion, and the cancellation operation portion are integrally formed.

10. The beverage container according to claim 6, wherein the vent blocking portion, the ventilation adjusting protruding portion, and the cancellation operation portion are integrally formed.

11. The beverage container according to claim 1, the ventilation adjusting protruding portion is in a semi-circled shape in a plane view.

* * * * *